US006049286A

United States Patent [19]

Forr

[11] Patent Number: 6,049,286

[45] Date of Patent: Apr. 11, 2000

[54] SENSOR WITH FALL-OFF DETECTION

[75] Inventor: David P. Forr, Mountainside, N.J.

[73] Assignee: Statistical Research, Inc., Westfield, N.J.

[21] Appl. No.: 09/065,859

[22] Filed: Apr. 24, 1998

[51] Int. Cl.[7] ..... G08B 21/00

[52] U.S. Cl. ..... 340/687; 340/686.1; 348/1

[58] Field of Search ..... 340/687, 686.1, 340/691.1, 568.1; 348/1, 2, 3, 4

[56] References Cited

U.S. PATENT DOCUMENTS

| | | | |
|---|---|---|---|
| 2,924,496 | 2/1960 | Rahmel | 348/1 |
| 4,150,371 | 4/1979 | Scaglione | 340/568.1 |
| 4,253,084 | 2/1981 | Topputo | 340/568.1 |
| 4,574,304 | 3/1986 | Watanabe et al. | 348/1 |
| 4,622,583 | 11/1986 | Watanabe et al. | 348/1 |
| 4,755,797 | 7/1988 | Kanaya | 340/506 |
| 4,984,462 | 1/1991 | Hass et al. | 340/619 |
| 5,072,213 | 12/1991 | Close | 340/572 |
| 5,235,414 | 8/1993 | Cohen | 348/1 |
| 5,532,732 | 7/1996 | Yuen et al. | 348/1 |
| 5,892,441 | 4/1999 | Woolley et al. | 340/539 |

*Primary Examiner*—Nina Tong
*Attorney, Agent, or Firm*—Chadbourne & Parke LLP

[57] ABSTRACT

A system having an attachable sensor for collecting television program data is provided. A first plate is attached to a surface, such as the side of a television set. A second plate, attached to the first plate, is part of the sensor and is attached to an actuator which activates a switch upon detachment of the plates from one another.

24 Claims, 3 Drawing Sheets

SENSOR WITH FALL-OFF DETECTION

FIELD OF THE INVENTION

This invention relates generally to attachable sensors, and more particularly to a television program data collection sensor attachable to a television, with a detector for determining when the sensor becomes detached from the surface.

BACKGROUND OF THE INVENTION

For decades, researchers have collected television audience information to develop television ratings that are useful to advertisers and broadcasters in evaluating the size and demographics of audiences for particular programming. In order to obtain such information, the researcher identifies a sample of households or individuals selected to represent a defined population. The defined population can be any population under review. For example, local television audiences, national television audiences, households whose incomes fall within a certain range, persons of a particular origin, or other groups may be of interest to the researcher. The researcher uses the information collected from a sample to produce television audience statistics and estimates for the defined population. Television audience information may include, but is not necessarily limited to, television status (on or off), program information, and the identity of the person or persons using the television at a given time period. The television information collected is essential when determining the demographics and the number of television users.

An example of a system utilized to provide some of the foregoing demographic information is described in U.S. Pat. No. 2,924,496, assigned to AC Nielson Company. In this system, a meter must be invasively attached to the television receiver, as well as to any cable converter and VCR attached to the television set. Thus, installation is cumbersome and may cause concern over possible signal interference or damage to the receiver, making the system less palatable to the participating household user than a non-invasive system. The resulting reluctance of households or individuals to participate as members of the sample audience may skew the sample audience demographics.

Furthermore, an invasive system in a house might be disconnected by a member of the household without prompt detection. If detection does not occur in a timely manner, the lack of participation in the sample audience will skew the results of the statistics and estimates based on the sample audience.

To overcome the problems associated with invasive television audience participation measurement systems, non-invasive systems are presently under development or have been developed by companies such as Statistical Research, Inc. of Westfield, N.J. Naturally, an essential element of a non-invasive system would be an external sensor to measure certain television status information, such as on/off condition or program identification information.

One potential problem with such a sensor is that there may be objection to permanent attachment, and non-permanent attachment can lead to inaccurate information. By example, a detached sensor may result in a television off condition signal, when indeed the television is on.

The present invention overcomes the foregoing problems by providing a non-invasive television audience participation measurement system attached to a television, with a means for detecting detachment. Although the present invention is contemplated for use with a television audience participation measurement system, such as a system for determining the on/off condition of a television, the present invention may be used to detect the detachment of any mountable sensor.

SUMMARY OF THE INVENTION

The present invention relates to a mountable data collection sensor having a detector for detecting when the sensor becomes detached from the mounting surface. This provides a means for alerting a data collection system when the sensor has become detached and is therefore not in its optimal position for collecting data. In the embodiment disclosed, the sensor is utilized in association with a television audience participation measurement system, and is fitted with an inductive coil for sensing the magnetic field associated with a proximate television to detect whether the television is on or off.

It is an object of this invention to provide a means for detecting when a sensor is removed from or has fallen off of a surface, such as the surface of a television set.

It is another object of this invention to provide a means for fastening a sensor to a surface in a non-permanent manner, including means to detect detachment.

It is still another object of this invention to provide a detachable sensor having a means for detecting detachment and including a coil having an inductance, and whose detected signal strength is dependent upon the magnetic field associated with a television, whereby the sensor may be utilized to determine television on/off condition.

It is yet another object of this invention to provide means for alerting a data collection system when a sensor is removed from or has fallen off of a surface.

DETAILED DESCRIPTION OF THE INVENTION

Reference will now be made in detail to a present preferred embodiment of the invention, an example of which is illustrated in the accompanying drawings.

Figure 1A:
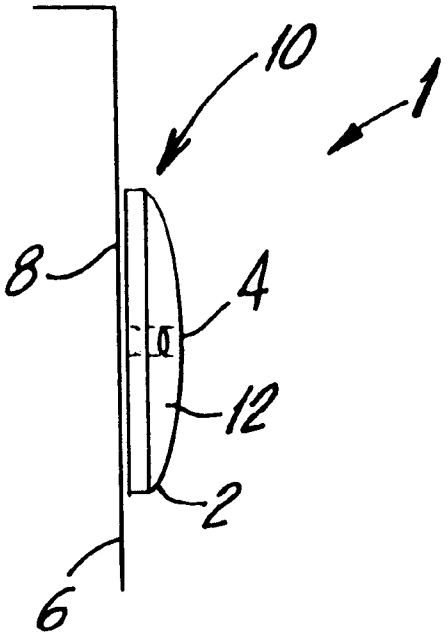
FIG. 1*a* is a side view of an attachment spot assembly for the attachment of a sensor.
Figure 1B:
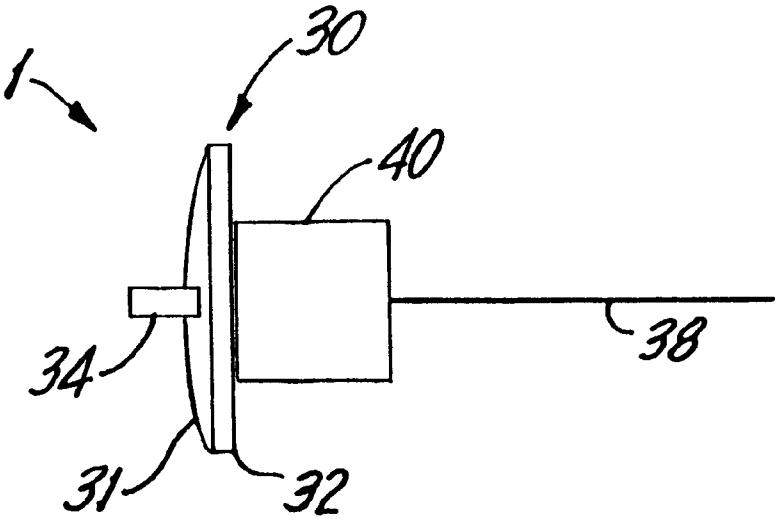
FIG. 1*b* is a side view of a sensor.

Referring now to the drawings, particularly FIGS. 1*a* and 1*b*, there is illustrated a sensor assembly 1 comprising a sensor 30 and attachment spot assembly or sensor mount 10. Sensor mount 10 shown in FIG. 1*a* comprises a disk or plate 2 having an outward-facing surface 12 to which sensor 30 having a mating surface 31 may be attached. In one embodiment, the attachment may be facilitated by providing an indentation 4 in disk or plate 2. Preferably, indentation 4 extends all the way through disk or plate 2 to form a hole. Disk or plate 2 may be attached to surface 6 using tape 8. As would be obvious to one of ordinary skill in the art, other adhesive or attachment means may be substituted for tape 8. In one preferred embodiment, surface 6 is the surface of a television set box. However, in other embodiments surface 6 may be the surface of other electronic equipment, such as communication, multimedia, or entertainment electronic equipment.

With reference now to FIG. 1*b,* a sensor 30 is shown including electromagnetic sensing device 40.

In one embodiment, electromagnetic sensing device 40 contains an inductive coil 46 which may be utilized to determine television on/off condition as detailed below. The present invention however, is not limited to this embodiment. As would be obvious to one of ordinary skill in the art, any sensor assembly sensitive to detachment may be utilized in conjunction with and achieve the benefits of the disclosed invention. As further depicted in FIG. 1*b,* wires 38 are provided to communicate information or data from the electromagnetic sensing device 40. In alternative embodiments, other means of appropriate communication, such as infrared, radio, or other form of electromagnetic transmission, may be utilized.

With reference again to FIG. 1*b,* sensor 30 has a disk or plate 32 provided with a mating surface 31 for attachment to surface 12 of sensor mount 10. One preferred means for attaching mating surface 31 with surface 12 includes the use of a hook and loop attachment means. Hook material may be incorporated onto surface 12 of disk or plate 2, thereby allowing attachment of mating surface 31 having loop material. Alternatively, loop material may be incorporated onto the surface 12 of disk or plate 2, thereby allowing attachment of mating surface 31 having hook material. Velcro™, manufactured by Velcro Industries B.V., provides a workable hook and loop attachment means. As would be obvious to one of ordinary skill in the art, other means for attaching may be used to secure sensor 30 to sensor mount 10.

In one embodiment, actuator 34 protrudes from disk or plate 32. Actuator 34 is shaped to fit inside of indentation 4 of sensor mount 10 (FIG. 1*a*). Upon attachment of disk or plate 32 to disk or plate 2, actuator 34 is depressed, while detachment causes actuator 34 to distend from disk 32. If indentation 4 extends all the way through disk or plate 2, as described above in one possible embodiment, then actuator 34 is depressed by contact with surface 6. A spring or other such device may be used to cause actuator 34 to distend from disk or plate 32. Electromagnetic sensing device 40 is attached to the other side of disk or plate 32. Wires 38 protrude from electromagnetic sensing device 40 for transmitting information to a data collection system.

Figure 2:
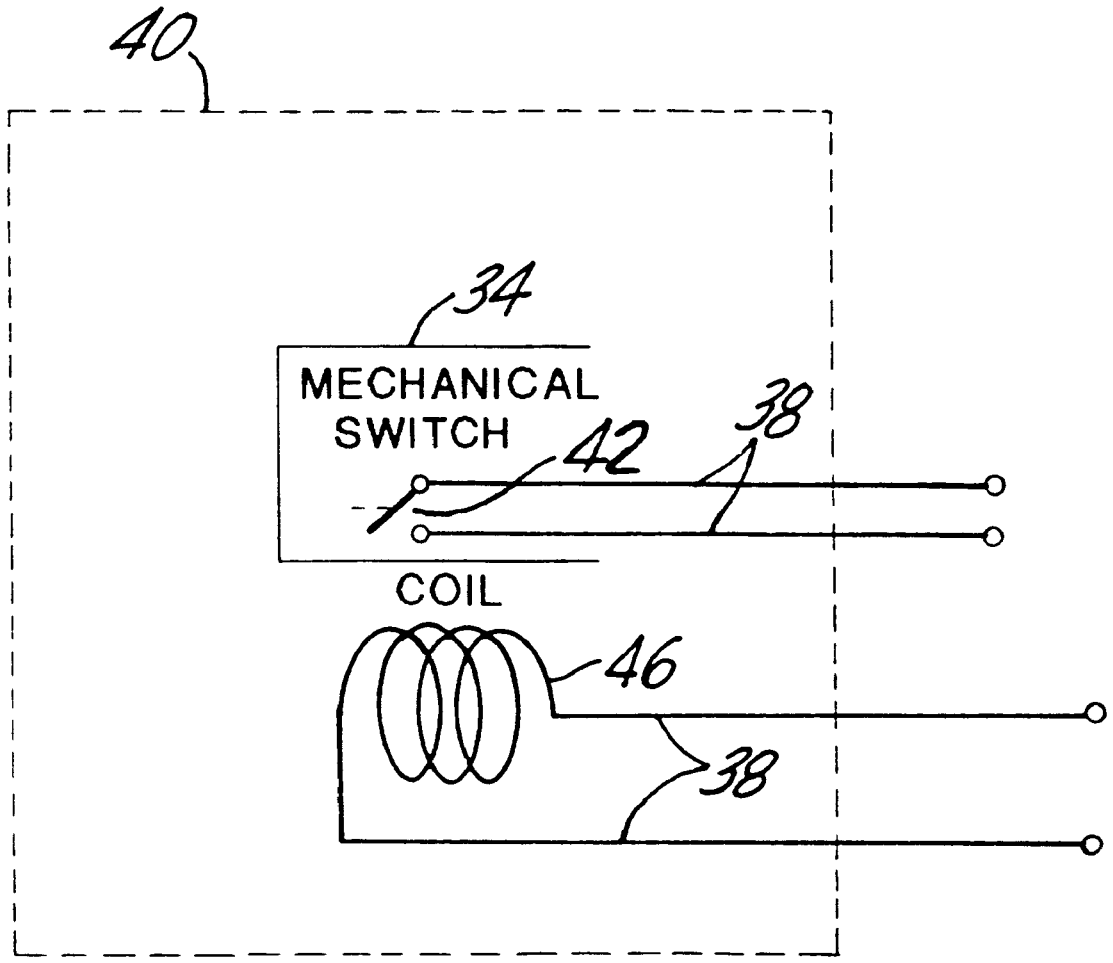
FIG. 2 is a partial circuit diagram of a possible parallel configuration of electronic components inside a sensor.

In one preferred embodiment, the electronic circuitry inside electromagnetic sensing device 40 includes mechanical switch 42 and coil 46, as shown in FIG. 2. Mechanical switch 42 is activated when disk or plate 32 and disk or plate 2 are attached, depressing actuator 34, and deactivated when disk or plate 32 and disk or plate 2 are detached, distending actuator 34. In another preferred embodiment wherein indentation 4 extends all the way through, disk or plate 2, actuator 34 may also be distended if disk or plate 2 detaches from surface 6, even if disk or plate 32 and disk or plate 2 are still attached. The deactivation of mechanical switch 42 sends a signal, such as a change in voltage or the opening or closing of a circuit, through wires 38 to a data collection system to indicate that sensor 30 is no longer connected to sensor mount 10. Optionally, the signal may be processed by another device between mechanical switch 42 and the data collection system.

In one embodiment, electromagnetic sensing device 40 has means to determine whether a television is on or off, for the purpose of sending the resulting information to a data collection system. One embodiment of such determining means comprises an inductive coil 46 through which flows a current that is affected by electromagnetic fields, such as the electromagnetic field generated by a television set that is turned on. When sensor 30 is attached to sensor mount 10, which in turn is attached to a television, the activation of the television causes a signal to be induced into coil 46, and the signal travels through wires 38 to a data collection system to indicate that the television is on. Conversely, the deactivation of the television removes the effect of the television on the current through coil 46. If sensor 30 becomes detached from sensor mount 10, the resulting distension of actuator 34 and deactivation of mechanical switch 42 alerts the data collection system that the lack of current flow through coil 46 is no longer a reliable indicator of the on/off status of the television.

Figure 3:
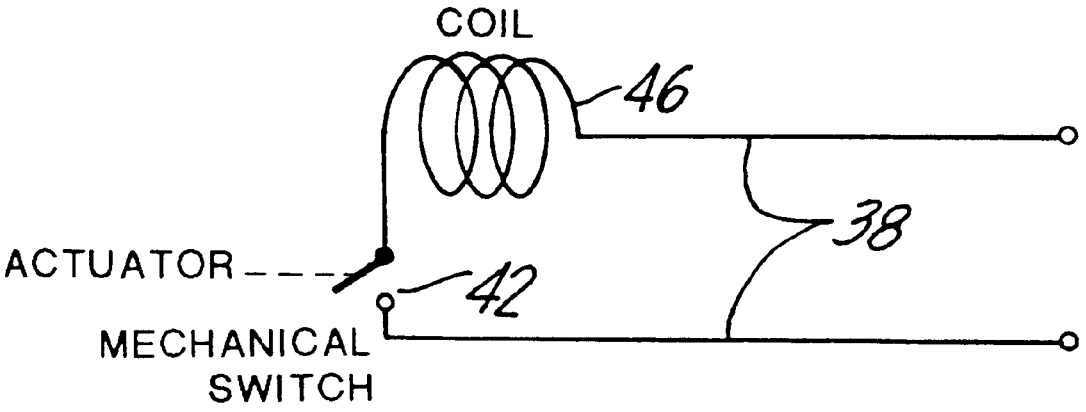
FIG. 3 is a partial circuit diagram of a possible serial configuration of electronic components inside a sensor.

In another preferred embodiment, mechanical switch 42 and coil 46 are in series, as shown in FIG. 3. Mechanical switch 42 is activated when disk or plate 32 and disk or plate 2 are attached, depressing actuator 34, and deactivated when disk or plate 32 and disk or plate 2 are detached, distending actuator 34. If sensor 30 becomes detached from sensor mount 10, the resulting distension of actuator 34 and deactivation of mechanical switch 42 causes an open circuit condition that alerts the data collection system that sensor 30 has become detached.

In other preferred embodiments, which are not shown in the drawings, actuator 34 and mechanical switch 42 are replaced by other means for detecting detachment of sensor 30. For example, altitude sensors, accelerometer, magnetic switches, hall-effect switches, optical sensors, and proximity detectors are examples of components that may be used to detect detachment of sensor 30 from sensor mount 10.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A system for detecting the detachment of a sensor, comprising:

a first plate with a first surface having, an aperture and a second surface having material for attachment to a surface of electronic equipment;

a detachably second plate with a first surface for attachment to said first surface of said first plate;

an actuator attached to said second plate and fitted to be received by said aperture, wherein said actuator has at least two positions, wherein said actuator is in a depressed position when said first surface of said second plate is attached to said first surface of said first plate and wherein said actuator is in a distended position when said first surface of said second plate is detached from said first surface of said first plate;

a switch, wherein said switch is activated by one of said at least two positions of said actuator; and an electromagnetic sensing device connected to a second surface of said second plate, said electromagnetic sensing device having a coil for detecting a proximate, activated said electronic equipment.

2. The system for detecting the detachment of a sensor of claim 1, wherein said material of said second surface of said first plate is an adhesive.

3. The system for detecting the detachment of a sensor of claim 1, wherein said switch is mechanically activated and has an open position and a closed position.

4. The system for detecting the detachment of a sensor of claim 1, wherein said aperture extends from said first surface of said first plate to said second surface of said first plate.

5. The system for detecting the detachment of a sensor of claim 1, wherein said electronic equipment is a television set.

6. The system for detecting the detachment of a sensor of claim 1, wherein said coil and said switch are in a series configuration.

7. The system for detecting the detachment of a sensor of claim 1, wherein said coil and said switch are in a parallel configuration.

8. The system for detecting the detachment of a sensor of claim 1, wherein:

said second surface of said first plate is normally attached to a surface of said proximate, activated electronic equipment;

said aperture of said first surface of said first plate extends through said first plate to create a hole extending from said first surface of said first plate to said second surface of said first plate; and said actuator is also in a distended position when said second surface of said first plate is detached from said surface of said proximate, activated electronic equipment.

9. A system for collecting data, comprising:

holder means for holding a detachably sensor means proximate to electronic equipment, said holder means being generally plate shaped and having a first surface with an aperture and a second surface;

first attachment means for attaching said second surface of said holder means to a surface of said electronic equipment; and second attachment means for attaching said sensor means to said first surface of said holder means;

wherein said detachably sensor means comprises:

electromagnetic sensing means for sensing actuation of said electronic equipment, actuator means interacting with said aperture for detecting proximity of said sensor means to said holder means, and detector means for creating a signal responsive to said actuator means.

10. The system for collecting data of claim 9, wherein said first attachment means comprises adhesive means.

11. The system for collecting data of claim 9, wherein said detector means comprises a mechanically activated switch having an open position and a closed position.

12. The system for collecting data of claim 9, wherein said aperture extends from said first surface of said first plate to said second surface of said first plate.

13. The system for collecting data of claim 9, wherein said electronic equipment is a television set.

14. The system for collecting data of claim 9, wherein:

said aperture of said first surface of said holder means extends to said second surface of said holder means to create a hole extending from said first surface of said holder means to said second surface of said holder means; and said actuator means interacts with said surface of said electronic equipment.

15. A system for detecting the detachment of a sensor, comprising:

a first plate with a first surface and a second surface having material for attachment to a surface of an electronic equipment;

a detachably second plate with a first surface for attaching to said first surface of said first plate;

a switch, wherein said switch is responsive to said second plate being detached from said first plate; and an electromagnetic sensing device connected, to a second surface of said second plate, said electromagnetic sensing device having a coil for detecting a proximate, activated said electronic equipment.

16. The system for detecting the detachment of a sensor of claim 15, further comprising a detector for detecting said second plate being detached from said first plate.

17. The system for detecting the detachment of a sensor of claim 15, wherein said material of said second surface of said first plate is an adhesive.

18. The system for detecting the detachment of a sensor of claim 15, wherein said electronic equipment is a television set.

19. The system for detecting the detachment of a sensor of claim 15, wherein:

said second surface of said first plate is normally attached to a surface of said activated electronic equipment;

said aperture of said first surface of said first plate extends through said first plate to create a hole extending from said first surface of said first plate to said second surface of said first plate; and said switch is also responsive to said first plate being detached from said surface of said activated electronic equipment.

20. A system for collecting data, comprising:

holder means for holding a detachably sensor means proximate to electronic equipment, said holder means being generally plate shaped and having a first surface and a second surface;

first attachment means for attaching said second surface of said holder means to a surface of said electronic equipment; and second attachment means for attaching said sensor means to said first surface of said holder means;

wherein said detachably sensor means comprises:

electromagnetic sensing means for sensing actuation of said electronic equipment and detector means for creating a signal responsive to said sensor means being detached from said holder means.

21. The system for collecting data of claim 20, wherein said first attachment means comprises adhesive means.

22. The system for collecting data of claim 20, wherein said detector means comprises detachment detection means.

23. The system for collecting data of claim 20, wherein said electronic equipment is a television set.

24. The system for collecting data of claim 20, wherein:

said aperture of said first surface of said holder means extends to said second surface of said holder means to create a hole extending from said first surface of said holder means to said second surface of said holder means; and said detector means for creating a signal is also responsive to said holder means being detached from said surface of said electronic equipment.

* * * * *